US008225885B2

(12) United States Patent
Wentworth et al.

(10) Patent No.: US 8,225,885 B2
(45) Date of Patent: Jul. 24, 2012

(54) JOINT FOR USE IN BACK REAMING

(75) Inventors: Steven W. Wentworth, Fountain Hills, AZ (US); Robert F. Crane, Oconomowoc, WI (US)

(73) Assignee: Earth Tool Company, LLC, Oconomowoc, WI (US)

( * ) Notice: Subject to any disclaimer, the term of this patent is extended or adjusted under 35 U.S.C. 154(b) by 120 days.

(21) Appl. No.: 12/387,475

(22) Filed: May 1, 2009

(65) Prior Publication Data

US 2010/0012379 A1 Jan. 21, 2010

Related U.S. Application Data

(60) Provisional application No. 61/126,092, filed on May 1, 2008.

(51) Int. Cl.
*E21B 17/10* (2006.01)

(52) U.S. Cl. ..... 175/325.5; 285/333; 166/242.6

(58) Field of Classification Search ..... 175/53, 175/320, 325.1, 325.2, 325.5; 285/333, 332.3, 285/92; 166/242.6
See application file for complete search history.

(56) References Cited

U.S. PATENT DOCUMENTS

| | | | | |
|---|---|---|---|---|
| 3,318,397 | A * | 5/1967 | Combes | 175/73 |
| 6,860,514 | B2 | 3/2005 | Wentworth et al. | 285/92 |
| 7,055,631 | B2 * | 6/2006 | Mitchell et al. | 175/325.5 |
| 2002/0139582 | A1 | 10/2002 | Caraway et al. | 175/53 |
| 2002/0189811 | A1 | 12/2002 | Wentworth et al. | 166/298 |
| 2003/0044238 | A1 | 3/2003 | Wentworth et al. | 405/184.3 |
| 2003/0166418 | A1 | 9/2003 | Wentworth et al. | 464/18 |

* cited by examiner

*Primary Examiner* — Daniel P Stephenson
*Assistant Examiner* — Kipp Wallace
(74) *Attorney, Agent, or Firm* — Tomlinson Rust McKinstry Grable

(57) ABSTRACT

A joint according to the invention for connecting a pair of members rotatable about a common axis end to end. A sleeve has a non circular profile on an inner surface thereof whereby the sleeve can be slidably mounted on non circular exterior surfaces of the first and second members when such surfaces are brought into alignment by rotation of one member relative to the other in a manner effective to pass torque from one member to the other by means of the non circular surfaces. A fluid release passage includes a radial port that extends from the first longitudinal fluid supply passage to a clearance between the sleeve and the first member, which clearance communicates with a second clearance between the sleeve and the second member, which second clearance has a discharge opening.

8 Claims, 6 Drawing Sheets

JOINT FOR USE IN BACK REAMING

This application claims priority of U.S. Provisional Application No. 61/126,092, filed May 1, 2008.

TECHNICAL FIELD

The invention relates to directional boring and, in particular to an improved joint for connecting tools utilized in directional boring to a drill string.

BACKGROUND OF THE INVENTION

Directional boring apparatus for making holes through soil are well known. The directional borer generally includes a series of drill rods joined end to end by joint couplings to form a drill string. The drill string is pushed or pulled though the soil by means of a powerful hydraulic device such as a hydraulic cylinder or gear rack mounted on the HDD machine. A drill head for boring in soil, rock or both is attached to the end of the drill string with a joint coupling and may include an ejection nozzle for water or other drilling fluid to assist in boring. In other applications, tools such as reamers, pipe bursters, impact machines, slitters and pullers are attached to the end of a drill string with a joint coupling and are used to place underground pipelines.

During forward drilling, the joint coupling trails the leading bit where cutting is performed. Generally, the joint is exposed to limited amounts of abrasion as the joint is typically the same size as the sonde housing and smaller than the 3 to 8 inch diameter bore created by the bit. Even during these conditions, joint couplings between a drill string and tool are subjected to severe torque loadings and longitudinal stresses in these operations.

Back reaming exposes the tooling to additional wear, especially the joint coupling. Additionally, the cuttings or local soils often collapse on the first drill rod and the joint coupling, increasing the abrasion they sustain during the ream and shortening their useful life overall. Drilling fluid reduces the propensity for this to happen by permitting the abrasive soil to flow away. In existing designs the reamer is designed to discharge fluid at multiple strategic locations to aid the back reamer in cutting rock or soil. This makes the reaming and cutting process easier, but does not provide the joint couplings or drill string with any protective drilling fluid.

Additionally, during the course of any drilling operation, be it forward drilling or back reaming, significant and unavoidable wear occurs on the threading between the male and female ends of the joint coupling, drill string and tooling. This is a serious problem, because when the threads no longer hold the couplings securely, the worn parts must be replaced. An existing design, U.S. Pat. No. 6,860,514 addresses this issue by providing re usable threading, but does not address the fundamental vulnerability of the sleeve encasing the joint threadings to abrasion and damage.

Failure of a joint in a horizontal drilling or back reaming operation can result in not only a tool stuck in a borehole or pipe, necessitating costly and time consuming excavation to recover the tool, or form a bore around the location at which the tool was lost, but can prevent separation of the reamer from the drill string in extreme cases of abrasion where the starter rod is worn through to the point of fracture by the abrasive conditions. This necessitates costly in ground repairs and part replacements. It is clear that a means for extending the lifetime of the joint coupling is needed. The present invention addresses this need.

SUMMARY OF THE INVENTION

The present invention provides a joint coupling with the protective benefits of drilling fluid. A joint according to the invention for connecting a pair of members rotatable about a common axis end to end includes a first member having a threaded end portion, a non circular exterior surface rearwardly of the threaded end portion, and a first longitudinal fluid supply passage and a second member having a threaded socket wherein the threaded end portion of the first member can be engaged, a second longitudinal fluid supply passage that communicates with the first longitudinal fluid supply passage, and a non circular exterior surface. A sleeve has a non circular profile on an inner surface thereof whereby the sleeve can be slidably mounted on the non circular exterior surfaces of the first and second members when such surfaces are brought into alignment by rotation of one member relative to the other, which sleeve is effective to pass torque from one member to the other by means of the non circular surfaces. A fluid release passage includes a radial port that extends from the first longitudinal fluid supply passage to a clearance between the sleeve and the first member, which clearance communicates with a second clearance between the sleeve and the second member, which second clearance has a discharge opening.

A back reamer assembly according to the invention comprises a back reamer threadedly coupled to an adapter, which adapter is threadedly coupled to a starter rod, wherein a joint as described above is provided wherein the adapter is the first member and the starter rod is the second member, which back reamer receives pressure fluid from the longitudinal fluid supply passages.

BRIEF DESCRIPTION OF THE DRAWINGS

In the accompanying drawings, like numerals represent like elements.

DETAILED DESCRIPTION

According to one embodiment of the disclosed invention, drill fluid normally moves down a central path in the drill rod, through the quick connect joint and then finally to the back reamer. In this embodiment of the invention, that central fluid path is tapped with what is effectively a controlled leak that delivers drilling fluid to an annular space within the torque sleeve of the joint preferably through a single metering orifice. The orifice can be sized as needed, or a plug can be used in its place, stopping discharge should conditions not require it. By collecting fluid in the annular space, it allows fluid to be discharged in modest amounts at the leading end or face of the torque sleeve during back reaming operations.

With a system flow rate during back reaming in the range of 10 to 50 gallons per minute, approximately 1 to 3 gallons per minute (about 5% to 30%) will be sidetracked to for discharge at the torque sleeve. In this manner, only a minor fraction (less than half, preferably less than a third) of the drilling fluid is diverted from its primary mission of serving the main reamer. The main job of the reamer is not affected, yet the life of the quick connect joint is enhanced.

Figure 1:
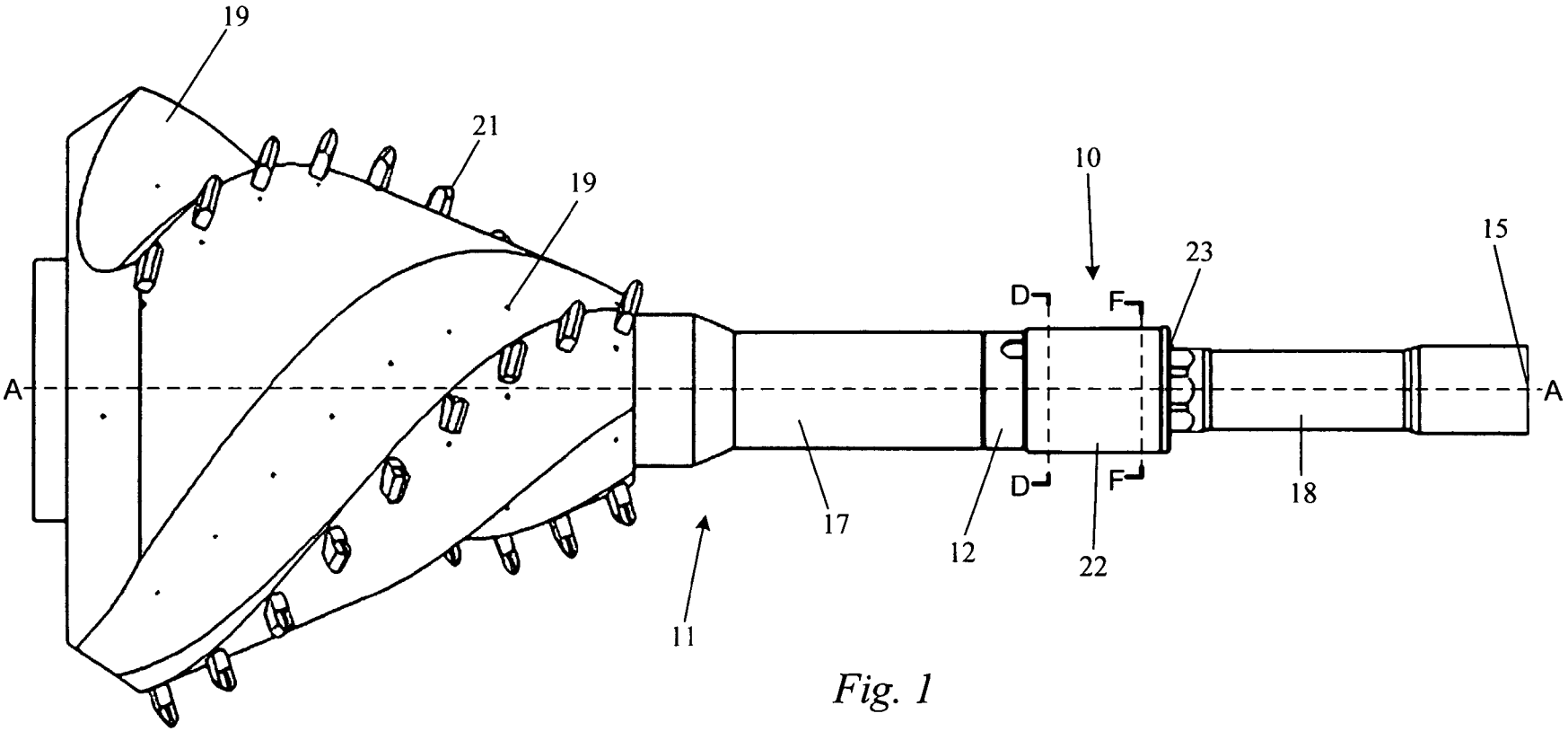
FIG. 1 is a side view of a back reaming assembly according to the invention.
Figure 2:
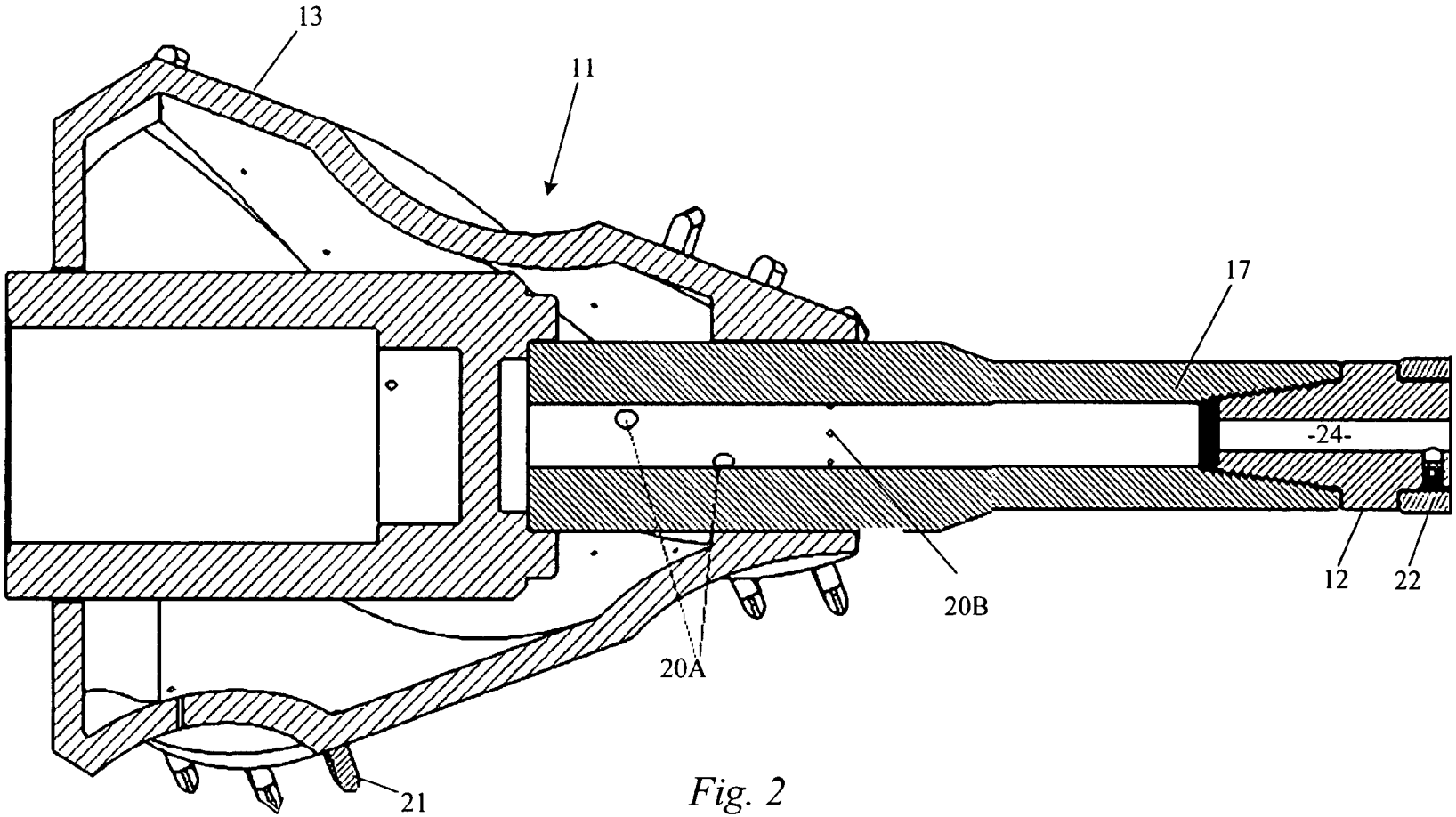
FIG. 2 is a partial lengthwise section along the line A A in FIG. 1.
Figure 3:
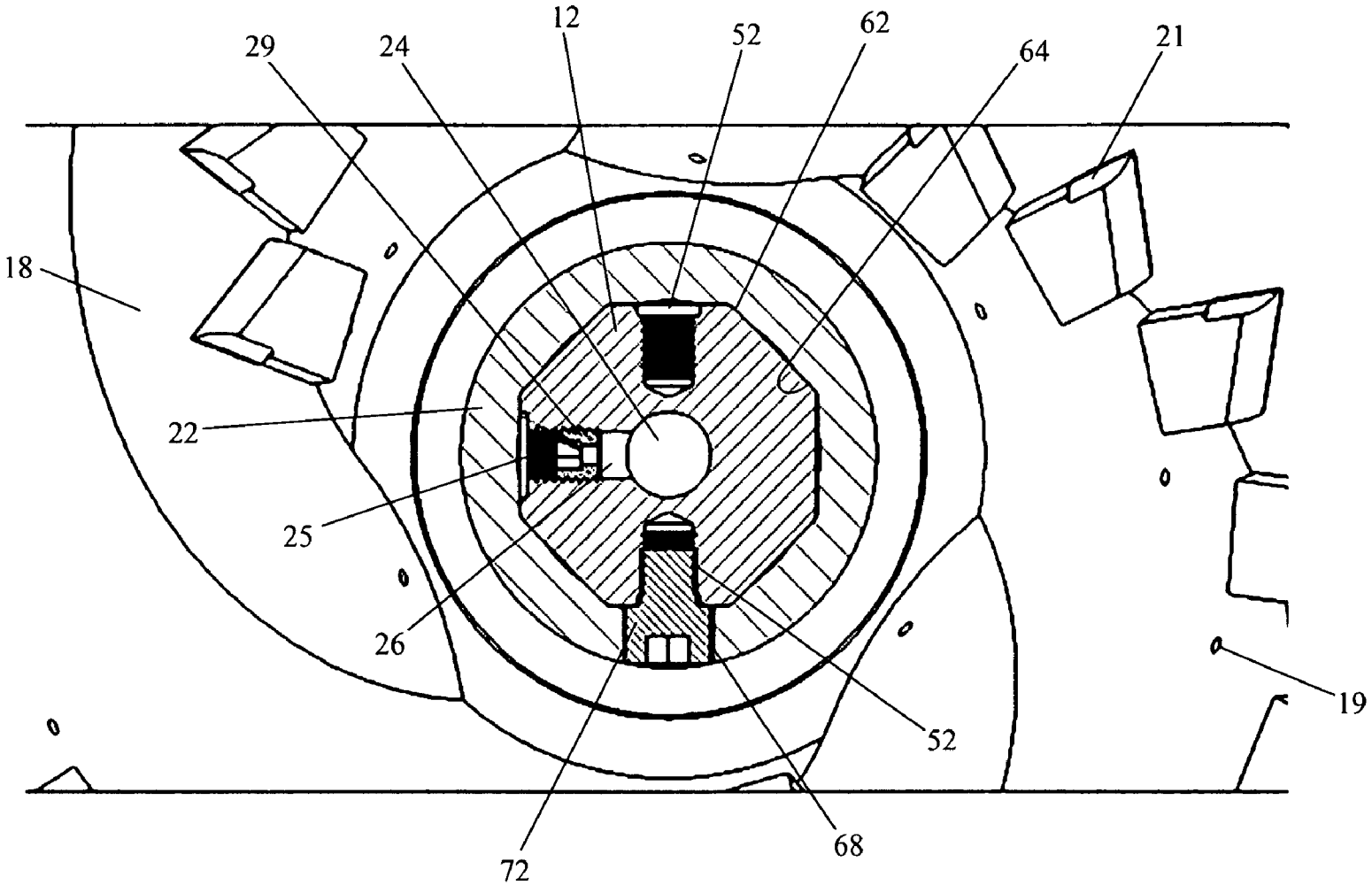
FIG. 3 is a cross section along the line D D in FIG. 1.
Figure 5:
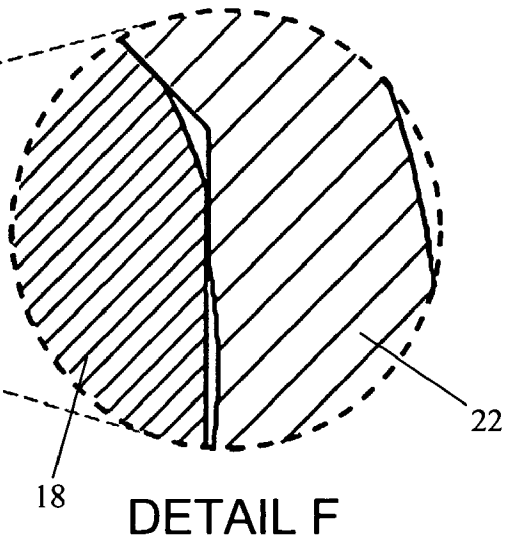
FIG. 5 is the circled area F in FIG. 4.
Figure 4:
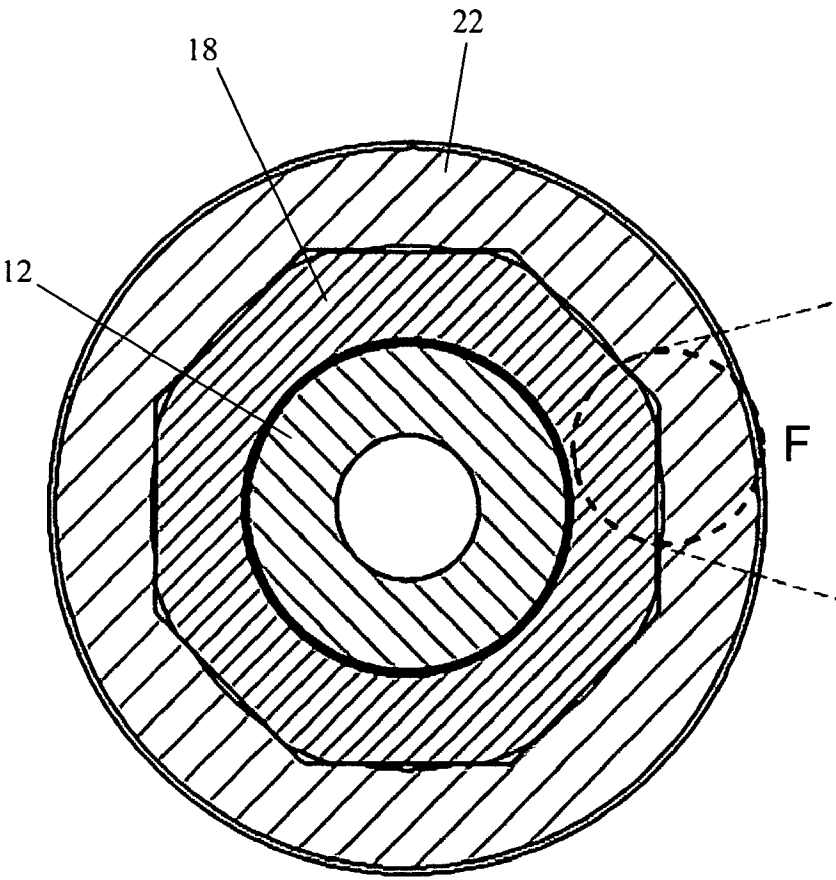
FIG. 4 is a cross section along the line F F in FIG. 1.
Figure 6:
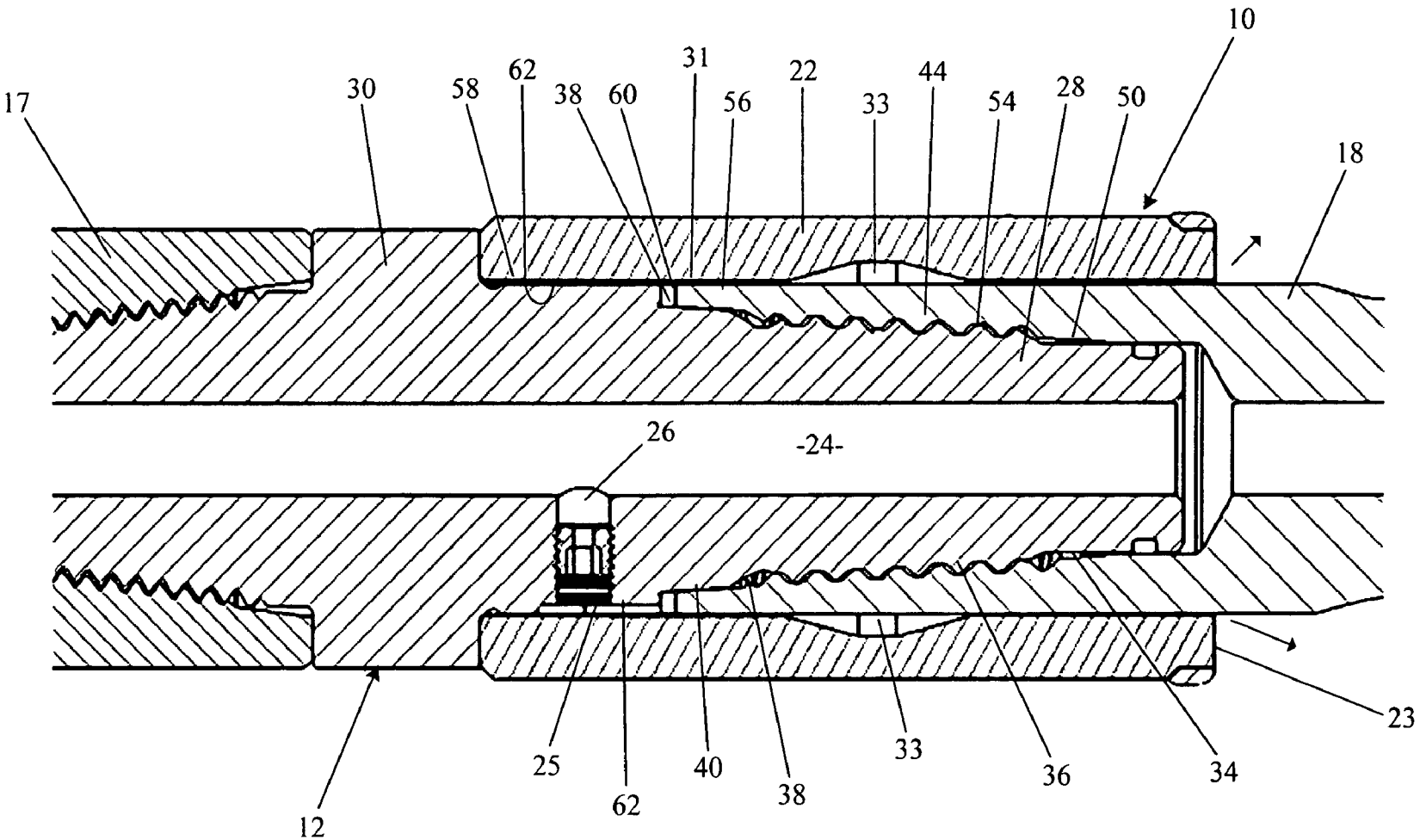
FIG. 6 is a partial lengthwise sectional view of the joint shown in FIG. 2.
Figure 7:
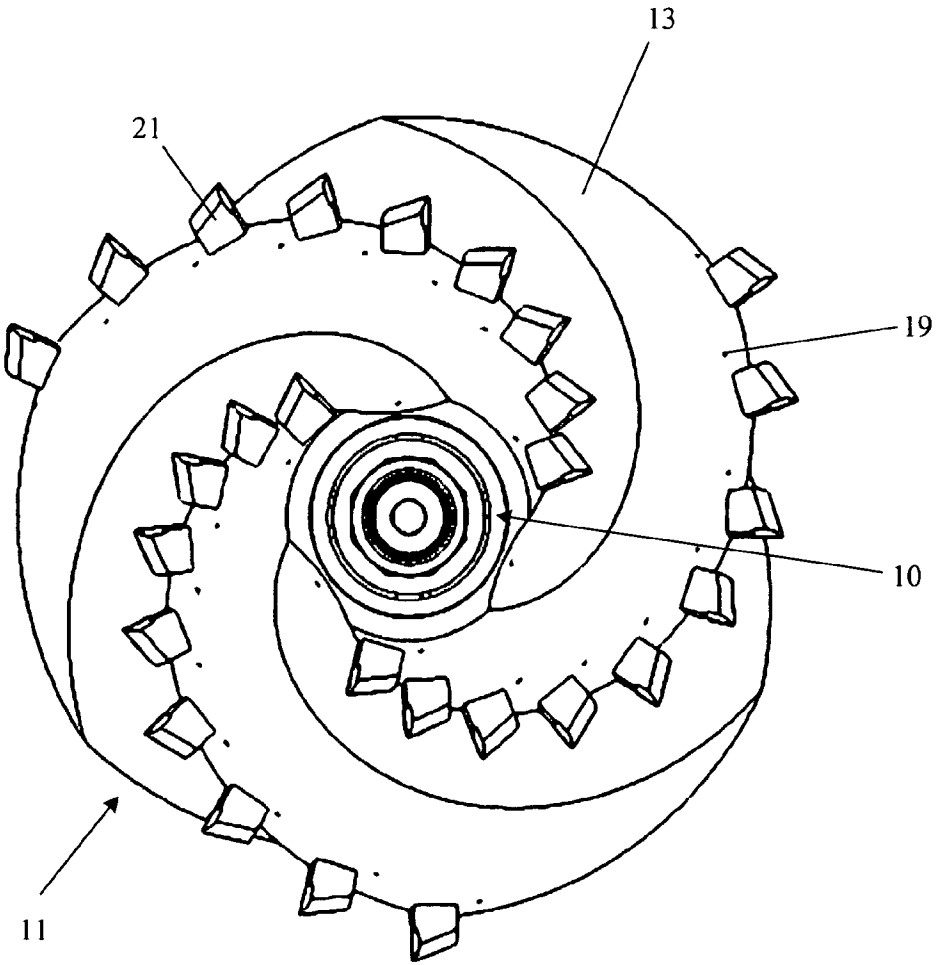
FIG. 7 is a front view of the assembly of FIG. 1.

Turning to FIGS. 1 to 8, a joint 10 according to the invention includes an adaptor 12, a starter rod 18, and a sleeve 22 configured to slide over adapter 12 and starter rod 18 to transfer torque between the starter rod and adapter upon rotation of the drill string. Joint 10 is part of a back reaming assembly 11 including a back reamer 13. Back reamer assembly 11 is configured for connection to a drill string at leading (coupling) end 15 of starter rod 18. Back reamer 13 has a central connecting shaft 17 that threadedly couples with one threaded end of adapter 12. Reamer 13 is provided with fluid ejection ports 19 and external cutting teeth 21 in a configuration known in the art.

A fluid passage 24 extends through adapter 12 and starter rod 18, allowing flow of a pressurized medium such as drilling fluid or pressurized air from the drill string through to the interior of the back reamer 13. Radial ports 20A, 20B may also be provided in shaft 17 to flow fluid into the interior of back reamer 13. A fluid passage tap (radial hole) 26 extends radially outward from fluid passage 24 to a non-circular exterior surface 62 of adaptor 12. Hole 26 allows a limited amount of drilling fluid to flow into a clearance 25 between adaptor 12 and sleeve 22, allowing fluid to be discharged in modest amounts at the leading end 23 of sleeve 22 during pullback (back reaming) operations. When not in use, fluid passage tap 26 can be fitted and sealed with a plug, or a nozzle 29 may be installed therein to control the flow rate. Clearance 25 communicates with a similar clearance 31 between starter rod 18 and sleeve 22. Preferably, an annular groove 33 formed in the inside surface of sleeve 22 enlarges the width of clearance 31 and enhances distribution of fluid around the entire circumference of sleeve 22 to better protect external areas most subject to wear. Clearances 25, 31 may be annular or formed as a series of parallel grooves as illustrated where there is limited or no fluid flow in the circumferential direction other than at the location of groove 33.

The disclosure of Wentworth, et al. U.S. Pat. No. 6,860, 514, Mar. 1, 2005, is hereby incorporated by reference herein. Adapter 12 includes a tapered threaded end portion 28. Threaded end portion 28 includes a forward pilot section 34, threads 36, a rear pilot section 38 and a tapered shoulder 40. The coupling end of starter rod 18 includes a threaded socket 44 with a tapered forward pilot section 50, threads 54, a rear tapered pilot section 56 and an end wall 60. Adapter 12 is also provided with a pair of threaded bolt holes 52 180 degrees apart that extend radially into the exterior surface of end portion 28 of adapter 12 and are alignable with a corresponding bolt hole 68 in sleeve 22. Alignable bolt holes 52 and 68 allow adapter 12 to be locked in position relative to sleeve 22 with threaded bolt 72.

Adapter 12 includes non circular profiled exterior surface 62 between central collar 30 and sloped shoulder 40. The coupling end of starter rod 18 includes an exterior surface 58 with the same or similar non circular profile as exterior surface 62 of adapter 12. Sleeve 22 includes a corresponding interior non circular profiled surface 64 adapted to slide over and engage surfaces 58 and 62 to transfer torque between adapter 12 and starter rod 18. As illustrated, the profile of surfaces 62 and 64 is octagonal, however, it is contemplated that other non circular profiles such as hexagonal, splined and similar profiles may be utilized.

It will be understood that the joint of the invention can be employed in other configurations and environments. For example, if connecting shaft 17 has a male thread, adapter 12 can be omitted and the joint made between starter rod 18, shaft 17 and sleeve 22 directly. These and other modifications are within the scope of the appended claims.

The invention claimed is:

1. A joint connecting a pair of members rotatable about a common axis end to end, comprising:

a first member having a threaded end portion, a non circular exterior surface rearwardly of the threaded end portion, and a first longitudinal fluid supply passage;

a second member having a threaded socket wherein the threaded end portion of the first member can be engaged, a second longitudinal fluid supply passage that communicates with the first longitudinal fluid supply passage, and a non circular exterior surface;

a sleeve having a non circular profile on an inner surface thereof whereby the sleeve can be slidably mounted on the non circular exterior surfaces of the first and second members when such surfaces are brought into alignment by rotation of one member relative to the other, which sleeve is effective to pass torque from one member to the other by means of the non circular surfaces; and a fluid release passage including a radial port that extends from the first longitudinal fluid supply passage to a clearance between the sleeve and the first member, which clearance communicates with a second clearance between the sleeve and the second member, which second clearance has a discharge opening.

2. The joint of claim 1, wherein the discharge opening is at a leading end of the sleeve.

3. The joint of claim 1, wherein the fluid release passage sized so that a minor fraction of pressure fluid flowing in the first longitudinal fluid supply passage is released.

4. The joint of claim 1, wherein the radial port has internal threads whereby a threaded plug can be installed therein.

5. The joint of claim 4, further comprising a threaded nozzle installed in the radial port that limits fluid flow through the fluid release passage.

6. A joint connecting a pair of members rotatable about a common axis end to end, comprising:

a first member having a threaded end portion, a non circular exterior surface rearwardly of the threaded end portion, and a first longitudinal fluid supply passage;

a second member having a threaded socket wherein the threaded end portion of the first member can be engaged, a second longitudinal fluid supply passage that communicates with the first longitudinal fluid supply passage, and a non circular exterior surface;

a sleeve having a non circular profile on an inner surface thereof whereby the sleeve can be slidably mounted on the non circular exterior surfaces of the first and second members when such surfaces are brought into alignment by rotation of one member relative to the other, which sleeve is effective to pass torque from one member to the other by means of the non circular surfaces; and a fluid release passage including a radial port that extends from the first longitudinal fluid supply passage to a clearance between the sleeve and the first member, which clearance communicates with a second clearance between the sleeve and the second member, which second clearance has a discharge opening;

wherein the clearance between the sleeve and the first member communicates with an annular groove formed on an inner surface of the sleeve, which annular groove distributes pressure fluid to the second clearance, which second clearance comprises a series of parallel flow passages in communication with the annular groove.

7. The joint of claim 1, further comprising alignable holes in the sleeve and first member for receiving a fastener to secure the sleeve to the first member.

8. The joint of claim 6, wherein the annular groove has a greater width than the first and second clearances.

* * * * *